US006652929B2

(12) United States Patent
Moriya et al.

(10) Patent No.: US 6,652,929 B2
(45) Date of Patent: Nov. 25, 2003

(54) RECORDING MEDIUM

(75) Inventors: Kenichi Moriya, Chiba (JP); Yuji Kondo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,530

(22) Filed: Oct. 24, 2001

(65) Prior Publication Data

US 2002/0076529 A1 Jun. 20, 2002

(30) Foreign Application Priority Data

Oct. 27, 2000 (JP) ..... 2000-329013

(51) Int. Cl.[7] ..... B41M 5/00

(52) U.S. Cl. ..... 428/32.12; 428/32.22; 428/32.34; 428/40.1; 428/41.8; 428/480

(58) Field of Search ..... 428/195, 40.1, 428/41.8, 354, 343, 480, 328, 214, 220, 32.12, 32.22, 32.34

(56) References Cited

U.S. PATENT DOCUMENTS

| | | | | |
|---|---|---|---|---|
| 4,202,870 A | | 5/1980 | Weber et al. | 423/630 |
| 4,242,271 A | | 12/1980 | Weber et al. | 260/448 |
| 4,723,129 A | | 2/1988 | Endo et al. | 346/1.1 |
| 4,879,166 A | | 11/1989 | Misuda et al. | 428/212 |
| 5,104,730 A | | 4/1992 | Misuda et al. | 428/304.4 |
| 5,264,275 A | | 11/1993 | Misuda et al. | 428/304.4 |
| 5,275,868 A | * | 1/1994 | Popat et al. | 428/195 |
| 5,508,084 A | * | 4/1996 | Reeves et al. | 428/172 |
| 5,589,246 A | * | 12/1996 | Calhoun et al. | 428/120 |
| 5,635,291 A | | 6/1997 | Yoshino et al. | 428/304.4 |
| 5,721,086 A | * | 2/1998 | Emslander et al. | 430/126 |
| 5,747,146 A | | 5/1998 | Kashiwazaki et al. | 428/206 |
| 5,846,647 A | | 12/1998 | Yoshino et al. | 428/328 |
| 5,866,220 A | * | 2/1999 | Rusincovitch et al. | 428/40.1 |
| 5,954,906 A | | 9/1999 | Abe et al. | 156/247 |
| 5,955,185 A | | 9/1999 | Yoshino et al. | 428/304.4 |
| 5,965,252 A | | 10/1999 | Santo et al. | 428/329 |
| 6,200,670 B1 | * | 3/2001 | Hosoi et al. | 428/212 |
| 6,423,390 B1 | * | 7/2002 | Harden | 428/40.1 |
| 6,472,064 B1 | * | 10/2002 | Ogawa et al. | 428/343 |
| 6,475,585 B1 | * | 11/2002 | Yamanashi et al. | 428/40.1 |

FOREIGN PATENT DOCUMENTS

| | | |
|---|---|---|
| EP | 0 701 904 A1 | 3/1996 |
| JP | 54-59936 A | 5/1979 |
| JP | 1-210484 A | 8/1989 |
| JP | 2-276670 A | 11/1990 |
| JP | 4-37576 A | 2/1992 |
| JP | 5-32037 A | 2/1993 |
| JP | 6-20043 U | 3/1994 |
| JP | 7-19346 U | 4/1995 |

(List continued on next page.)

OTHER PUBLICATIONS

Brunauer, et al., "Adsorption of Gases in Multimolecular Layers", The Journal of the American Chemical Society,vol. LX, pp. 309–319 (1938).

*Primary Examiner*—Bruce H. Hess
*Assistant Examiner*—B. Shewareged
(74) *Attorney, Agent, or Firm*—Fitzpatrick, Cella, Harper & Scinto

(57) ABSTRACT

Disclosed herein is a recording medium comprising a base material, an ink-receiving layer containing an alumina hydrate provided on one side of the base material, an adhesive layer provided on the side opposite to the ink-receiving layer of the base material, and a release sheet covering the adhesive layer, wherein the surface of the adhesive layer on the side of the release sheet has such structure that recessed portions and projected portions are regularly repeated, and a recessed and projected surface corresponding to the recessed portions and the projected portions of said surface of the adhesive layer is formed by the release sheet covering the adhesive layer.

10 Claims, 1 Drawing Sheet

FOREIGN PATENT DOCUMENTS

| | | | |
|---|---|---|---|
| JP | 7-138541 | A | 5/1995 |
| JP | 7-232473 | A | 9/1995 |
| JP | 8-30 | U | 1/1996 |
| JP | 8-132731 | A | 5/1996 |
| JP | 8-282089 | A | 10/1996 |
| JP | 9-66664 | A | 3/1997 |
| JP | 9-76628 | A | 3/1997 |
| JP | 11-323790 | A | 11/1999 |
| JP | 2000-229473 | A | 8/2000 |

* cited by examiner

RECORDING MEDIUM

BACKGROUND OF THE INVENTION

1. Field of the Invention

The present invention relates to a recording medium suitable for use in ink-jet recording. The recording medium, particularly useful as a seal or label for ink-jet recording, has an adhesive layer for sticking on its back surface, permits forming a high-quality image, and is excellent in conveyability into a printer from a stacked state.

2. Related Background Art

An ink-jet recording system is a system in which minute droplets of an ink are ejected by any one of various working principles to be applied to a recording medium such as paper, thereby making a record of images, characters and/or the like. A printer, in which the ink-jet recording system is used, has such features that recording can be conducted at high speed and with a low noise, multi-color images can be formed with ease, printing patterns are very flexible, and particular development and fixing treatments are unnecessary. As a result, the printer is widely used as a recording apparatus of images in various applications including information instruments. The ink-jet recording system has also begun to be used in recording of full-color images. Images formed by a multi-color ink-jet system are comparable in quality with multi-color prints by a plate making system and photoprints by a color photographic system, and such printed images can be obtained at lower cost than the usual multi-color prints and photoprints when the number of copies is small. With the improvement in recordability such as speeding up and high definition of recording, and full-coloring of images in the ink-jet recording system, recording apparatus and recording methods have been improved. Thus, there is a need to improve the quality of the recording media.

In recent years, recording media having a coating layer using an alumina hydrate of a boehmite structure have been proposed, and disclosed in, for example, U.S. Pat. Nos. 4,879,166 and 5,104,730, and Japanese Patent Application Laid-Open Nos. 2-276670, 4-37576 and 5-32037.

The ink-receiving layer containing the alumina hydrate in each of these recording media has the following merits:

(1) a dye in an ink is well fixed to the ink-receiving layer because the alumina hydrate has a positive charge, transparency is good, and an image high in print density and good in coloring can be provided;

(2) problems such as bronzing in an black ink and deterioration of light fastness, which may be caused in some cases by using a silica compound, do not arise: and (3) the resulting recording medium is preferred to the conventional recording media in points of image quality (particularly, image quality in a full-color image) of an image formed thereon, gloss and application to sheets for OHP.

On the other hand, with the speeding-up of ink-jet recording, there has been a demand for improvement of conveyance performance so as to be adapted to a continuous automatic paper feed mechanism in a recording apparatus (printer) in which a plurality of paper sheets is continuously conveyed.

In ordinary sheet-like recording media, however, the ink-receiving layers and the back surfaces (surface opposite to the ink-receiving layer) are both high in smoothness. Such recording media are easy to adhere to each other because the smooth surfaces are opposed to each other when a plurality of such recording media are stacked in a printer. As a result, a failure in conveyance may occur in some cases. In particular, the frequency thereof tends to increase in an environment high in temperature and humidity.

In the ink-receiving layer containing the alumina hydrate, the surface of the ink-receiving layer is easy to be blemished according to handling thereof. When plural sheets of the recording medium, which has been subjected to a sand blasting treatment at the back surface of a base material as disclosed in Japanese Patent Application Laid-Open No. 8-282089, are stacked in a printer and conveyed one by one, the ink-receiving layers of the recording media may be blemished by sharp irregularities formed by the sand blasting treatment in some cases to markedly deteriorate the image quality of images formed thereon.

Processed films having an adhesive layer are disclosed in, for example, Japanese Patent Application Laid-Open No. 2000-229473, Japanese Utility Model Application Laid-Open Nos. 6-20043, 7-19346 and 8-30, Japanese Patent Application Laid-Open Nos. 7-138541 and 11-323790, etc.

The conventional adhesive processed sheets generally spread are composed of an adhesive sheet formed by evenly coating a surface of a base material with an adhesive, and a release sheet provided on the adhesive-coated smooth surface of the base material. The surface formed by the release sheet is also smooth. Upon use thereof, the release sheet is peeled, and the adhesive sheet is stuck on the surface of an adherend. This operation is often conducted by hand.

Therefore, the conventional adhesive processed sheets have the problem of air entering easily between the sheet and the surface of an adherend. The portion where the air has entered is blistered (projected), and thus a blister occurs on the surface side of the adhesive sheet. In particular, this problem is marked when the size of the adhesive sheet is larger than the palm of the hand.

When the surface of the ink-receiving layer is rubbed with hand or some other means to eliminate the air from the air-entered portion (blister), the ink-receiving layer is blemished, or finger marks are left thereon, so that the image quality of the resulting recorded article may be markedly deteriorated in some cases. When such an operation is excessively conducted, blemishes also tend to occur on the ink-receiving layer containing alumina hydrate.

When the adhesive sheet is stuck on a more or less wrong position, the sheet must be stuck again. However, the adhesive sheet stuck once is difficult to be stuck again in a good state because the adhesive sheet has strong adhesive strength, and so the base material of the adhesive sheet is separated, or the adhesive sheet is wrinkled or folded during its peeling operation. In addition, the quality of the adhesive sheet is lowered.

Since the surface of the release sheet on the side of the adhesive layer is smooth in the ordinary adhesive sheet, the adhesive sheets are easy to adhere to each other, since the smooth surfaces thereof are opposed to each other like the recording media both surfaces of which are smooth when plural adhesive sheets are stacked in a printer, so that a failure in conveyance may occur in some cases. The frequency of this problem also tends to increase in an environment high in temperature and humidity in particular.

SUMMARY OF THE INVENTION

It is an object of the present invention to provide a recording medium particularly useful as a seal or label for ink-jet recording, which is excellent in conveyability into a printer from a stacked state and hard to develop surface defects on the surface of its ink-receiving layer during conveyance in the printer and also upon sticking of a recorded article on an adherend after ink-jet recording, and prevents the image quality of an image formed thereon from being impaired.

The present inventors have carried out an extensive investigation with a view toward achieving the above object, thus leading to completion of the present invention. Namely, the above object can be achieved by the present invention described below.

According to the present invention, there is thus provided a recording medium comprising a base material, an ink-receiving layer containing an alumina hydrate provided on one side of the base material, an adhesive layer provided on the side opposite to the ink-receiving layer of the base material, and a release sheet covering the adhesive layer, wherein the surface of the adhesive layer on the side of the release sheet has such structure that recessed portions and projected portions are regularly repeated, and a recessed and projected surface corresponding to the recessed portions and the projected portions of said surface of the adhesive layer is formed by the release sheet covering the adhesive layer.

In the recording medium according to the present invention, the regularly recessed portions and projected portions are formed in the surface (release sheet surface) composed of the release sheet covering the adhesive layer, whereby adhesion between the release sheet surfaces or between the release sheet surface and the ink-receiving layer surface is effectively prevented even when such recording media are stacked, and so the conveyability into a printer from a stacked state is improved. In addition, since the recessed and projected portions are formed in the release sheet surface, the surface does not become a coarse irregular surface, so that even when the release sheet surface comes into contact with the ink-receiving layer surface, the ink-receiving layer is prevented from being blemished. In addition, the irregularities in the release sheet surface are transferred to the adhesive layer surface, and the irregularities are formed in this adhesive layer surface, whereby resticking after the recording medium is stuck once as an adhesive sheet on an adherend can be simply conducted with good operability.

DESCRIPTION OF THE PREFERRED EMBODIMENTS

Figure 1:
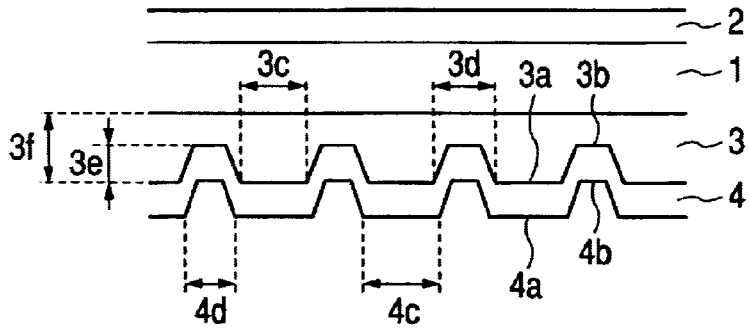
FIG. 1 is a cross-sectional view illustrating a part of an exemplary recording medium according to the present invention.
Figure 2:
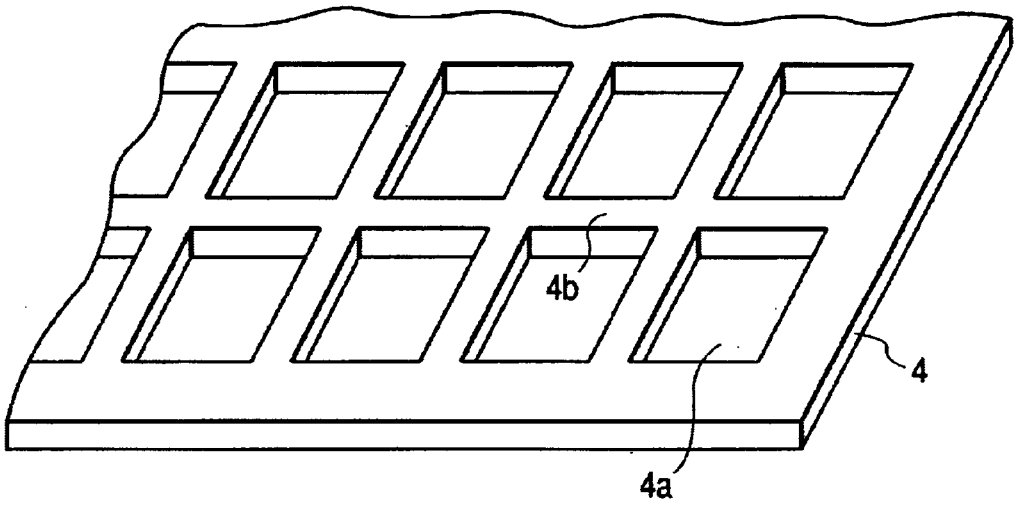
FIG. 2 illustrates a release sheet viewed from the side of an adhesive layer.

The present invention will hereinafter be described in detail. An exemplary recording medium according to the present invention is illustrated in FIG. 1. This recording medium has such structure that an ink-receiving layer 2 containing an alumina hydrate and a binder is formed on one side of a sheet-like base material 1, and an adhesive layer 3 and a release sheet 4, which each have regularly recessed portions and projected portions, are successively laminated on the surface (back surface) opposite to the ink-receiving layer 2 of the base material 1.

As the base material 1, may be used any base material so far as it is of a material and a form with which the desired properties as a recording medium, such as mechanical strength, can be achieved. Examples of such a base material include paper sheets such as woodfree paper, medium grade paper, art paper, bond paper, recycled paper, baryta paper, cast-coated paper and corrugated fiberboard: films, sheets and plates formed of a plastic material such as polyethylene terephthalate, diacetate, triacetate, cellophane, celluloid, polycarbonate, polyimide, polyvinyl chloride, polyvinylidene chloride, polyacrylate, polyethylene or polypropylene; glass plates or sheets; and fabrics formed of fiber such as cotton, rayon, acrylic, nylon, silk or polyester. The base material may be suitably chosen for use from the above-mentioned materials according to various conditions such as the intended recording application of the resulting recording medium, the use of a recorded image and the adhesiveness to compositions for forming the ink-receiving layer and the adhesive layer.

As the paper, various kinds of paper as mentioned above may be used. However, paper having a basis weight of about 50 to 200 g/m$^2$ is preferably used. Further, woodfree paper, cast-coated paper and baryta paper are preferred from the viewpoints of a feeling upon use, a feeling of higher grade and a feeling of a reasonable price in the case where the resulting recording medium is used as a seal or label.

As the plastic film, various kinds of plastic films as mentioned above may be used. However, a plastic film having a thickness of about 20 to 200 $\mu$m is preferably used. Further, a polyethylene terephthalate film is preferred from the viewpoints of texture, dimensional stability to heat and cuttability.

In order to improve adhesiveness of the base material to the ink-receiving layer, the base material may be subjected to a surface treatment such as a corona discharge treatment or flame treatment, or provided with an easy-adhesion layer as an undercoat.

As preferable examples of the alumina hydrate used in the formation of the ink-receiving layer provided on the base material 1, may be mentioned alumina hydrates represented by the general formula:

$$Al_2O_{3-n}(OH)_{2n}.mH_2O \quad (1)$$

wherein n is an integer of 0, 1, 2 or 3, and m is a number of 0 to 10, preferably 0 to 5, with the proviso that m and n are not 0 at the same time. In many cases, $mH_2O$ represents a releasable aqueous phase which does not participate in the formation of a crystal lattice. Therefore, m may take a value other than an integer. When this kind of material is heated, m may reach a value of 0. A preferable alumina hydrate in the present invention is an alumina hydrates having a boehymite structure or amorphous form when analyzed by the X-ray diffractiometry. In particular, the alumina hydrates disclosed in Japanese Patent Application Laid-Open Nos. 7-232473. 8-132731, 9-66664 and 9-76628 may be preferably used.

The alumina hydrate of the above-described structure is adjusted in physical properties of pores in the course of the production thereof. In order to provide a recording medium satisfying the requirements of BET specific surface area and total pore volume in the ink-receiving layer which will be described subsequently, it is preferable to use an alumina hydrate having a pore volume of 0.1 to 1.0 ml/g. When the pore volume of the alumina hydrate is outside this range, it may be difficult in some cases to set the total pore volume of the resulting ink-receiving layer within a preferable range which will be described subsequently.

With respect to the BET specific surface area, an alumina hydrate having a BET specific surface area of 40 to 500 m$^2$/g is preferably used. When the BET specific surface area of the alumina hydrate is outside this range, it may be difficult in some cases to set the specific surface area of the resulting ink-receiving layer within a preferable range which will be described subsequently.

As the ink-receiving layer containing the alumina hydrate, an ink-receiving layer of such structure that the alumina hydrate is bound by a binder is preferably used. No particular limitation is imposed on the binder so far as it has the desired binding function. However, a water-soluble polymer is preferably used. As examples thereof, may be mentioned polyvinyl alcohol or modified products thereof, starch or modified products thereof, gelatin or modified products thereof, casein or modified products thereof, gum arabic, cellulose derivatives such as carboxymethyl cellulose, hydroxyethyl cellulose and hydroxypropylmethyl cellulose, conjugated diene copolymer latexes such as. SBR latexes, NBR latexes and methyl methacrylate-butadiene copolymers, functional-group-modified polymer latexes, vinyl copolymer latexes such as ethylene-vinyl acetate copolymers, polyvinyl pyrrolidone, maleic anhydride polymers or copolymers thereof, acrylic ester copolymers, and the like. These binders may be used either singly or in any combination thereof.

The mixing ratio by weight of the alumina hydrate to the binder may be selected from a range of preferably from 5:1 to 20:1. When the amount of the binder is controlled within the above range, the mechanical strength of the resulting ink-receiving layer can be more enhanced, and so occurrence of cracking and dusting upon the formation of the ink-receiving layer can be prevented, and a more preferable pore volume can be retained in the ink-receiving layer.

Besides the alumina hydrate, other pigments, for example, inorganic pigments such as calcium carbonate, kaolin, talc, calcium sulfate, barium sulfate, titania, zinc oxide, zinc carbonate, aluminum silicate, alumina, silicic acid, sodium silicate, magnesium silicate, calcium silicate and silica, organic pigments such as plastic pigments and urea resin pigments, and mixtures thereof, may be mixed for use so far as no detrimental influence is thereby imposed on the effects of the present invention. These pigments are preferably used in a proportion of at most 20% based on the weight of the alumina hydrate from the viewpoint of surface hardness and glossiness of the resulting ink-receiving layer and image quality of an image to be formed thereon.

To the ink-receiving layer of the recording medium according to the present invention, or a coating formulation for forming the ink-receiving layer, which will be described subsequently, may be added pigment dispersants, thickeners, pH adjustors, lubricants, flowability modifiers, surfactants, antifoaming agents, water-proofing agents, foam suppressors, releasing agents, foaming agents, penetrants, coloring dyes, optical whitening agents, ultraviolet absorbents, antioxidants, preservatives, mildewproofing agents and the like, as needed, so far as no detrimental influence is thereby imposed on the effects of the present invention.

The ink-receiving layer is formed by applying a dispersion (coating formulation) comprising the alumina hydrate, and the binder and other components selected as necessary for the end application intended onto a predetermined surface of the base material by means of a coater and then drying the dispersion as needed. No particular limitation is imposed on the coating process, and a coating process, to which any of various coating systems such as a blade coating system, air-knife coating system, roll coating system, brush coating system, gravure coating system, kiss coating system, extrusion system, slide hopper (slide beat) system, curtain coating system and spray coating system is applied, may be used. The drying of the dispersion applied on the base material by the coater may be carried out by means of any of various driers, for example, hot air dryers such as a direct tunnel drier, arch dryer, air loop dryer and sino curve air float dryer, infrared dryers, and dryers making good use of microwaves or the like.

The coating weight of the dispersion applied on the base material is within a range of from 0.5 to 60 g/m$^2$, preferably from 5 to 45 g/m$^2$in terms of dry solids content. In order to achieve good ink absorbency and resolution, it is desirable to apply the dispersion in such a manner that the thickness of the ink-receiving layer is at least 15 $\mu$m, preferably at least 20 $\mu$m. particularly preferably at least 25 $\mu$m.

The physical property values (for example, total pore volume and BET specific surface area) of the ink-receiving layer thus obtained are determined by not only the alumina hydrate used, but also various production conditions such as the kind and mixing amount of the binder, the concentration, viscosity and dispersed condition of the coating formulation, the kind of the coater, the kind of the coating head, the coating weight, the air flow of the drying air, and the temperature conditions and direction of blast upon the drying. Accordingly, these conditions may be suitably selected to preset the physical properties of the resulting ink-receiving layer.

The total pore volume of the ink-receiving layer is preferably within a range of from 0.1 to 1.0 cm$^3$/g. If the pore volume of the ink-receiving layer is greater than the upper limit of the above range, cracking and dusting may tend to occur on such an ink-receiving layer in some cases. If the pore volume is smaller than the lower limit of the above range, the ink absorbency of the ink-receiving layer, particularly, the ink absorbency when multi-color printing is conducted, cannot be sufficiently ensured, so that bleeding may occur on an image formed in some cases.

The BET specific surface area of the ink-receiving layer is preferably within a range of from 20 to 450 m$^2$/g. If the BET specific surface area is smaller than the lower limit of the above range, the glossiness of such an ink-receiving layer becomes low, and its haze increases, so that an image formed thereon may be liable to wear a white haze. If the BET specific surface area is greater than the upper limit of the above range, such an ink-receiving layer may become easy to cause cracking.

The pore volume of the alumina hydrate, and the total pore volume and BET specific surface area of the ink-receiving layer are such values as determined by the nitrogen adsorption and desorption method.

As the ink-receiving layer, may be used that having an internal space disclosed in Japanese Patent Application Laid-Open No. 9-66664.

Since the ink-receiving layer of the recording medium according to the present invention is formed mainly of the alumina hydrate, a high-quality image high in optical density and excellent in ink absorbency, dye-fixing ability, coloring, transparency, glossiness, stability and light fastness can be formed.

As the adhesive of the adhesive layer formed on the surface (back surface) opposite to the ink-receiving layer of the base material 1, may be used any adhesive so far as it has adhesiveness necessary for the adhesive layer and such viscosity (softness) that regular recessed portions and projected portions can be formed, and it may be chosen for use from various kinds of adhesives. It is preferable to select an adhesive free of stickiness by squeeze-out of the adhesive from an end or the like of the resulting recording medium in a finishing step such as cutting. When the recording medium is intended to be provided as that easy to stick again when it is used as an adhesive sheet, It is preferable to use an easily releasable adhesive.

When the adhesive is squeezed out from an end or the like of the recording medium, there is a possibility that the adhesive squeezed out may adhere or be transferred to a conveying system in a printer to deteriorate the conveyance performance of the printer about the future. There is also a possibility that recording media may become easy to adhere to each other by the adhesive squeezed out, or frictional force may be increased excessively to fail to achieve good conveyance performance.

The thickness of the adhesive layer is preferably within a range of from 5 to 55 μm. If the adhesive layer is too thin, the initial adhesive strength of the resulting recording medium when it is used as an adhesive sheet to stick it tends to become weak and make it liable to be peeled off. However, such a recording medium tends to cause little squeezing-out of the adhesive from an end or the like thereof. If the adhesive layer is too thick, the initial adhesive strength of the resulting recording medium when it is used as an adhesive sheet to stick it is strong and sufficient. However, such a recording medium tends to become sticky at its ends or the like due to great squeezing-out of the adhesive from the ends or the like thereof. Accordingly, it is preferable to suitably select the thickness of the adhesive layer according to the kind and the like of the adhesive. The thickness is preferably within the above range from the viewpoint of practical use, with a range of from 15 to 45 μm being more preferred.

The thickness of the adhesive layer in the present Invention means a thickness represented by 3*f* in the case illustrated in FIG. 1.

In the formation of the adhesive layer in the present invention, any of conventionally known adhesives of the solvent type or aqueous type may be used. Examples of such adhesives include adhesives making use of a resin such as a vinyl acetate resin, acrylic resin, vinyl acetate-acrylic copolymer, vinyl acetate-vinyl chloride copolymer, ethylene-vinyl acetate copolymer or polyurethane resin, and adhesives making use of rubber such as natural rubber, chloroprene rubber or nitrile rubber.

As a coating method of the adhesive, may be used a method such as comma coating, gravure coating, gravure reverse coating or roll coating. An adhesive can be applied to a surface opposite to the ink-receiving layer of the base material, or to a release sheet and then dried as needed, thereby forming the adhesive layer.

The adhesive strength of the adhesive layer is desirably within a range of from 100 to 2,000 g/25 mm, preferably from 200 to 1,500 g/25 mm in terms of a peeling strength as measured against an adherend composed of stainless steel by the 180° peeling test in accordance with JIS Z 0237.

The release sheet 4 provided so as to cover the adhesive layer 3 is released from the adhesive layer 3 after the recording medium is stuck on an adherend. As this release sheet, any sheet may be suitably chosen for use from those composed of paper or a plastic according to various conditions. As the release sheet, may be preferably used a plastic film which is relatively even and causes little burr at ends of the like of the recording medium after conducting finishing such as cutting.

When paper is used as the release sheet, a sheet with a plastic such as polyethylene laminated on the adhesive side of the paper may be preferably used. The thickness of the laminate can be controlled to about 5 to 100 μm, preferably about 30 to 50 μm.

When a plastic film is used as the release sheet, a plastic such as polyethylene terephthalate, diacetate, triacetate, cellophane, celluloid, polycarbonate, polyimide, polyvinyl chloride, polyvinylidene chloride, polyacrylate, polyethylene or polypropylene may be used as a material thereof. Any of these plastic films may be suitably used so far as it is generally available. However, a film formed of polyethylene terephthalate is preferred from the viewpoints of cost, ecology (disposability) and recyclability. The thickness of the plastic film used as the release sheet is preferably about 20 to 75 μm from the viewpoints of practical use and availability from market.

In the present invention, a recessed and projected structure formed in the surface of the laminate structure having the adhesive layer and the release sheet can be obtained by, for example, forming a release sheet having a recessed and projected structure, forming an adhesive layer on the release sheet and then laminate this laminated sheet on a predetermined surface of a base material. The formation of recessed and projected portions in the release sheet can be conducted by, for example, subjecting the release sheet to embossing by heating the release sheet and pressing a roller, in the surface of which the desired recessed and projected portions have been formed, against the release sheet, or by suitably using the process disclosed in Japanese Patent Application Laid-Open No. 1-210484 or the like.

The recessed and projected portions in the release sheet are preferably regular from the viewpoint of efficient production process and the like. The form of each of the projected portions (4*a* in FIG. 1) on the release sheet is preferably such that the top is substantially flat, and the angle of each corner is sharp. An irregular recessed and projected surface structure the projected portions of which are sharp, which is obtained by, for example, sand blasting treatment, easily blemishes the ink-receiving layer of the recording medium when the ink-receiving layer comes into contact therewith, so that the quality of an image formed on such an ink-receiving layer may be markedly deteriorated in some cases.

According to the recording media of the present invention, frictional force when plural recording media are stacked in a printer is lowered compared with the case where the smooth surfaces come into contact with each other, since the ink-receiving layer having a smooth surface comes into contact with the release sheet having the recessed and projected surface structure, so that good conveyability from a stacked state can be achieved. In addition, the recessed and projected structure is regular, whereby the frictional force is not lowered with a partial bias, but evenly lowered, so that better conveyability can be achieved. The top of each of the projected portions on the release sheet is formed in a form (for example, substantially flat) which does not blemish the ink-receiving layer, whereby the damage of the ink-receiving layer is prevented when the surface of the release sheet comes into contact with the ink-receiving layer. As a result, the deterioration of image quality is can be prevented.

In addition, since the release sheet has a structure that recessed portions and projected portions are regularly repeated over the whole surface composed of the release sheet, the rigidity of the recording medium is lowered as a secondary effect, so that its conveyability within a printer is also improved. Further, strain caused upon the formation of the adhesive layer is easy to escape (internal stress is easy to relax), so that curling of the recording medium can be controlled with ease.

Figure 3:
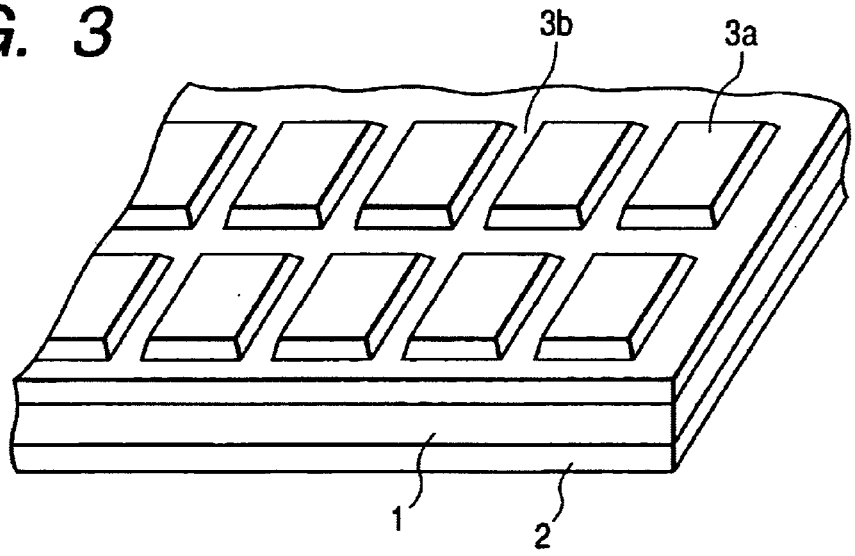
FIG. 3 illustrates an adhesive layer viewed from the side of a release sheet.

When the release sheet is peeled off from the recording medium in the present invention to expose the adhesive layer, an adhesive sheet, in which the recessed and projected structures are regularly arranged on the surface on which the adhesive layer is exposed, is formed. For example, an adhesive sheet in which independent projected portions of an adhesive are regularly scattered on the exposed adhesive layer as illustrated in FIG. 3 can be provided. When this adhesive sheet is stuck on the surface of an adherend, only the projected portions (3*a*) of the recessed and projected structure formed in the adhesive layer 3 come into close contact with the surface of the adherend, and moreover a space communicating with the outside is produced between the adhesive layer 3 and the surface of the adherend, so that air escapes out through the space. Therefore, even when an excessive amount of air enters between the adherend and the adhesive layer, particularly, between the projected portions of the adhesive layer and the adherend, the air can be easily removed outside. Therefore, a sticking operation can be simply and easily conducted, thereby preventing the surface of the ink-receiving layer from being blemished or stained with fingerprints by applying excessive force thereto. Accordingly, the quality of an image recorded thereon is not deteriorated. The ink-receiving layer containing the alumina hydrate tends to be blemished when an excessive load is applied thereto for correcting a blister portion caused by entrapment of air bubbles upon sticking of the adhesive sheet on an adherend using the adhesive layer. The formation of the recessed and projected structure on the surface of the adhesive layer as described above is extremely effective from the viewpoint of preventing the occurrence of such a problem.

When the recording medium is stuck as an adhesive sheet through the adhesive layer on an adherend, portions coming into contact with the adherend are mainly the tops of the projected portions of the adhesive layer because the surface of the adhesive layer has the recessed and projected structure, so that the contact area with the adherend is lessened. Therefore, the adhesive sheet can be easily peeled off and stuck again even when it has been stuck on a wrong position.

On the other hand, when the recording medium is stuck as an adhesive sheet on the adherend, and the time goes on, the tops of the projected portions of the adhesive layer deform to increase the contact area, thereby enhancing the adhesive strength.

When the base material and adhesive layer making up the recording medium are transparent, the transparency in the adhesive layer is enhanced when the adherend is brought into close contact with the adhesive layer over the substantially whole surface thereof by the deformation of the projected portions of the adhesive layer. Therefore, the see-through of the recording medium can also be enhanced to provide a transparent adhesive seal or label.

The structure in which recessed portions and projected portions are regularly repeated on the surface of the adhesive layer, i.e., the structure that projected portions and recessed portions are regularly repeated in any given direction along the surface of the adhesive layer, is obtained correspondingly to the recessed and projected structure imparted to the release sheet. Example of the form of the projected portions in this recessed and projected structure include square poles, truncated pyramids, small cloud shapes (undefined forms), truncated cones and honey combs, and various variants thereof based on these basic forms. Any form may be suitably selected for use from among these forms. The arrangement of the projected portions viewed from above on the side of the adhesive layer (release sheet) is such that each recessed portion can communicate with the outside when the adhesive layer comes into close contact with an adherend as shown in FIG. 3.

It is preferred that the width (for example, 3*c* in FIG. 1) of each of the projected portions of the adhesive layer obtained correspondingly to the recessed and projected structure of the release sheet be 0.05 to 1 mm, the interval (for example, 3*d* in FIG. 1) between the projected portions be 0.1 to 1 mm, and the height (for example, 3*e* in FIG. 1) be 0.005 to 0.1 mm. The width of the projected portion is a width of the top of the projection which is a trapezoid in section in the case of FIG. 1. When the form is in another form, for example, when the form of the projected portion viewed from above of the adhesive layer is in the form of a linear or curve-containing band, of a circle, of an ellipse, or of a rectangle, it is preferred that the width of the band portion, the radius of the circle, the breadth (minor axis) of the ellipse, or the length of at least one side of the rectangle be within the range defined as to the above width.

If the width of the projected portions of the adhesive layer is smaller than 0.05 mm, the contact area of the adhesive layer with an adherend is decreased, so that the predetermined adhesive strength may not be achieved in some cases. If the width is greater than 1 mm, the contact area of the adhesive layer with adherend is increased, so that it may be difficult in some cases to remove the air to the outside. If the interval between the projected portions is smaller than 0.1 mm, an air-removing groove formed between the adhesive layer and the adherend becomes narrow, so that it may be difficult in some cases to remove the air to the outside. If the mutual interval is greater than 1 mm, a great amount of air enters when the recording medium is stuck as an adhesive sheet on an adherend, so that it may be difficult in some case to effectively remove the air. In addition, when the projected portions of the adhesive layer is deformed with time to form an even layer for the purpose of achieving see-through, the air-removing groove becomes too wide, so that it may be difficult in some cases to form the even layer. If the height of the projected portions of the adhesive layer is smaller than 0.005 mm, the space communicating with the outside produced between the adhesive layer and the surface of the adherend is too small, so that it may be difficult in some cases to remove the air entered when the adhesive sheet is stuck on the adherend. If the height is greater than 0.1 mm, the adhesive is easy to squeeze out from ends and the like of the recording medium upon a finishing step such as cutting in the production process of the recording medium, so that disadvantages such as stickiness may occur in some cases.

It is preferred that the width (4*c*) of each of the projected portions (4*a* in FIG. 1) of the regular recessed and projected structure of the release sheet be 0.1 to 1 mm. and the interval (4*d*) between the projected portions be 0.05 to 1 mm. If the width (4*c*) of the projected portions (4*a*) of the release sheet is smaller than 0.1 mm, the substantially flat surfaces of the projected portions (4*a*) become small, namely, the above-described problem offered in the case where the interval (3*d*) between the projected portions (3*a*) of the adhesive layer obtained by the regular recessed and projected structure of the release sheet is smaller than 0.1 mm may arise in some cases. If the width (4*c*) is greater than 1 mm, the substantially flat surfaces of the projected portions (4*a*) become great, and the contact area when such recording media are stacked with the release sheet surface brought into contact with the ink-receiving layer becomes great, so that the frictional force is increased, and good conveyability into a printer from the stacked state may not be achieved in some cases under high-temperature and high-humidity environment in particular. In addition, the ink-receiving layer may be easy to be blemished during conveyance of the recording medium in some cases.

If the interval (4*d*) between the projected portions (4*a*) of the release sheet is smaller than 0.05 mm, the contact area of the substantially flat surfaces of the projected portions (4*a*) with the surface of the ink-receiving layer per unit area when such recording media are stacked with the release sheet surface of one recording medium brought into contact with the ink-receiving layer of the other recording medium becomes great, namely, the total contact area with the ink-receiving layer becomes great, so that the frictional force is increased, and good conveyability into a printer from the stacked state may be hard to be achieved in some cases under high-temperature and high-humidity environment in particular. If the mutual interval is greater than 1 mm, the substantially flat surfaces of the projected portions (4*a*) become small, namely, the above-described problem offered in the case where the width (3*c*) of the projected portions (3*a*) of the adhesive layer obtained by the regular recessed and projected structure of the release sheet is greater than 1 mm may arise in some cases.

As described above, the recessed and projected structure of the release sheet exhibits an effect to improve conveyability. In order to achieve better conveyability, however, an antistatic treatment layer may also be provided on a surface opposite to the adhesive layer of the release sheet. In particular, when the release sheet is a plastic film, the provision of the antistatic treatment layer on the surface opposite to the adhesive layer of the release sheet is very effective for achieving better conveyability, since plastic films do generally not possess antistatic property necessary for eliminating static electricity. Examples of antistatic treatment agents include surfactants, conductive polymers, binder polymers, inorganic fine particles, polymeric fine particles, and conductive agents or conductive substances. This layer may be either transparent-finished or matte-finished. Resins as the antistatic treatment agents include acrylic resins, vinyl acetate resins, hydrolyzed polyvinyl acetate, vinyl chloride resins, cellulose acetate butyrate resins, cellulose acetate propionate resins, carbonate resins, polyester resins, urethane resins, epoxy resins, melamine-formaldehyde resins and styrene resins. However, the present invention is not limited thereto. Examples of a preferable polymer binder used in a composition for the above coating include melamine-formaldehyde resins and 15 to 75%-hydrolyzed polyvinyl acetates. The binder polymers may be crosslinked by using an acid catalyst such as benzoic acid, p-toluenesulfonic acid, n-butylphosphoric acid, a carboxylic acid amine salt or alkylsulfonic acid. Examples of the inorganic particles used in the antistatic treatment layer include particles of silica, clay, talc, diatomaceous earth, calcium carbonate, barium sulfate, aluminum silicate, synthetic zeolite, alumina, zinc oxide and mica. Examples of organic particles preferably used include plastic pigments such as polymethyl methacrylate, polystyrene, copolymers of such monomers, polyvinyl chloride, polyethylene, polypropylene, polyvinylidene chloride and polycarbonate. However, the present invention is not limited thereto. These substances may be used either singly or in any combination thereof.

The recording media according to the present invention may be applied to various recording processes. Among others, they may be preferably applied to image forming processes using water-based inks, particularly, ink-jet recording processes. Examples of the water-based inks include those comprising principally a coloring material (dye or pigment), a water-soluble organic solvent and water. Preferable examples of the dye include water-soluble dyes represented by direct dyes, acid dyes, basic dyes, reactive dyes and food colors. However, any dyes may be used so far as they provide images satisfying required performance such as fixing ability, coloring, brightness or clearness, stability, light fastness and the like according to the constitution of the ink-receiving layer of the recording media.

The water-soluble dyes are generally used by dissolving them in water or a solvent composed of water and an organic solvent. As a preferable solvent component for these dyes, may be used a mixed solvent composed of water and a water-soluble organic solvent. It is however preferable to control the content of water in an ink within a range of from 20 to 90% by weight.

Examples of the water-soluble organic solvent include alkyl alcohols having 1 to 4 carbon atoms, such as methyl alcohol; amides such as dimethylformamide; ketones and keto-alcohols such as acetone: ethers such as tetrahydrofuran: polyalkylene glycols such as polyethylene glycol; alkylene glycols the alkylene moiety of which has 2 to 6 carbon atoms, such as ethylene glycol; glycerol; lower alkyl ethers of polyhydric alcohols, such as ethylene glycol methyl ether; and the like.

Among these many water-soluble organic solvents, the polyhydric alcohols such as diethylene glycol, and the lower alkyl ethers of polyhydric alcohols, such as triethylene glycol monomethyl ether and triethylene glycol monoethyl ether are preferred. The polyhydric alcohols are particularly preferred because they have an effect as a lubricant for preventing the clogging of nozzles in a recording head when an ink is applied to an ink-jet recording apparatus, in which the clogging is caused by the evaporation of water in an ink in the recording head due to the deposition of a water-soluble dye.

A solubilizer may be added to the inks. Nitrogen-containing heterocyclic ketones are typical solubilizers. Its object is to highly enhance the solubility of the water-soluble dye In the solvent. For example, N-methyl-2-pyrrolidone and 1,3-dimethyl-2-imidazolidinone are preferably used. In order to further improve the properties of inks, additives such as viscosity modifiers, surfactants, surface tension modifiers, pH adjustors and resistivity regulative agents may be added.

As a method for applying inks to the ink-receiving layer of the recording medium according to the present invention to conduct recording, may be preferably used an ink-jet recording method. Such an ink-jet recording method may be any system so far as it can effectively eject an ink from a nozzle as ink droplets to apply them to the ink-receiving layer. No particular limitation is imposed on the method for ejecting the ink from the nozzle. However, an ink-jet system described in Japanese Patent Application Laid-Open No. 54-59936, in which an ink undergoes a rapid volumetric change by an action of thermal energy applied to the ink, so that the ink is ejected from a nozzle by the working force generated by this change of state, may be used effectively.

The present invention will hereinafter be described in more detail by the following Examples and the like. However, the present invention is not limited to these examples.

EXAMPLES 1 to 8 AND COMPARATIVE EXAMPLES 1

Preparation of Ink-receiving Layer (A)

1) Preparation of Alumina Hydrate

Aluminum dodeoxide (aluminum tridodecanoate) was prepared in accordance with the process described in U.S. Pat. No. 4,242,271. The aluminum dodeoxide (aluminum tridodecanoate) was then hydrolyzed In accordance with the process described in U.S. Pat. No. 4,202,870 to prepare an alumina slurry. Water was added to the alumina slurry until the solids content of the alumina hydrate reached 7.9%, The pH of the alumina slurry added with water was 9.5. A 3.9% nitric acid solution was added to this slurry to adjust the pH of the slurry, thereby obtaining colloidal sol.

This colloidal sol was spray-dried at 85° C. to obtain an alumina hydrate. The BET specific surface area and pore volume of this alumina hydrate were 200 $m^2/g$ and 0.70 $cm^3/g$, respectively. The BET specific surface area and pore volume were determined in accordance with the following respective methods.

1) BET Specific Surface Area

The BET specific surface area was determined by calculation In accordance with the method of Brunauer, et al. (J. Am. Chem. Soc., Vol. 60, 309, 1938).

2) Pore Volume

After an alumina hydrate sample was subjected to a deaeration treatment at 120° C. for 24 hours, measurement was conducted using the nitrogen adsorption and desorption method by means of an "Autosorb I" (trade name, manufactured by Quanta Chrome Co.).

3) Formation of Ink-receiving Layer

Polyvinyl alcohol (Gohsenol NH18, trade name, product of The Nippon synthetic Chemical Industry Co., Ltd.) was dissolved or dispersed in ion-exchanged water to obtain a 10% by weight solution. The alumina hydrate obtained above was similarly dispersed in ion-exchanged water to obtain a 20% by weight dispersion. These polyvinyl alcohol solution and alumina hydrate dispersion were weighed out so as to give a mixing ratio by weight of 1:10 in terms of solids content and mixed with each other under stirring, thereby obtaining a mixed dispersion. The mixed dispersion was applied by die coating onto a transparent PET film (Lumirror, trade name, product of Toray Industries, Inc.) having a thickness of 75 $\mu$m. and then dried to obtain ink-receiving Layer (A) having a thickness of 40 $\mu$m.

The BET specific surface area and total pore is volume of the ink-receiving layer thus obtained were 160 $m^2/g$ and 0.55 $cm^3/g$, respectively. These values were determined in accordance with the respective methods used for the alumina hydrate.

Preparation of Ink-receiving Layer (B)

An alumina hydrate was obtained in accordance with the process described in Synthesis Example 1 of Alumina Hydrate in Examples of Japanese Patent Application Laid-Open No. 9-66664. More specifically, aluminum dodeoxide (aluminum tridodecanoate) was first prepared in accordance with the process described in U.S. Pat. No. 4,242,271. The aluminum dodeoxide (aluminum tridodecanoate) was then hydrolyzed in accordance with the process described in U.S. Pat. No. 4,202,870 to prepare an alumina slurry. Water was added to the alumina slurry until the solids content of the alumina hydrate reached 7.9% by weight. The pH of the alumina slurry thus obtained was 9.5. A 3.9% nitric acid solution was added to this slurry to adjust the pH of the slurry.

The alumina slurry was aged under the following aging conditions to obtain colloidal sol.

Aging Conditions:

pH before aging: 6.0

Aging temperature: 158° C.

Aging time: 4.2 hours

Aging apparatus: autoclave.

This colloidal sol of the alumina hydrate was spray-dried with an inlet temperature of 120° C. to obtain alumina hydrate powder. The crystal structure of the alumina hydrate was boehmite, and the particle form was a flat plate. The physical property values of the alumina hydrate were determined in accordance with the respective method described above. The measurement results are shown below.

Particle form: plate

Average particle diameter (nm): 27.2

Aspect ratio: 6.4

Spacing (nm): 0.618

Crystal diameter (nm): 7.5.

Ink-receiving Layer (B) was formed in the same manner as in Ink-receiving Layer (A) except that the alumina hydrate obtained by the above-described process was used.

The BET specific surface area and total pore volume of Ink-receiving Layer (B) were 200 $m^2/g$ and 0.60 $cm^3/g$, respectively, as determined by the same methods as in Ink-receiving Layer (A).

Preparation of Ink-receiving Layer (C)

Ink-receiving Layer (C) containing an alumina hydrate was obtained in accordance with the process described in Example 20 of Japanese Patent Application Laid-Open No. 9-76628. More specifically, aluminum dodeoxide (aluminum tridodecanoate) was prepared in accordance with the process described in U.S. Pat. No. 4,242,271. The aluminum dodeoxide (aluminum tridodecanoate) was then hydrolyzed in accordance with the process described in U.S. Pat. No. 4,202,870 to prepare an alumina slurry. Water was added to the alumina slurry until the solids content of the alumina hydrate reached 7.9%. The pH of the alumina slurry added with water was 9.5. A 3.9% nitric acid solution was added to this slurry to adjust the pH of the slurry, thereby obtaining colloidal sol. This colloidal sol was spray-dried at 75° C. to obtain Alumina Hydrate B. The BET specific surface area and pore volume of this alumina hydrate were determined in accordance with the following respective methods and found to be 235.6 $m^2/g$ and 0.59 $cm^3/g$, respectively.

1) Pore Volume (PV)

After an alumina hydrate sample was subjected to a deaeration treatment at 120° C. for 24 hours, measurement was conducted using the nitrogen adsorption and desorption method by means of an "Autosorb I" (trade name, manufactured by Quanta Chrome Co.).

2) BET Specific Surface Area (SA)

The BET specific surface area was determined by calculation in accordance with the method of Brunauer, et al.

Alumina Hydrate B (100 parts by weight) was added to a mixed solvent (420 parts by weight) of deionized water/DMF (weight ratio: 8/2) and stirred for 30 minutes at a rotating speed of 1,450 rpm by means of a disperser (Portable Mixer A510, trade name, using DS impeller blade, manufactured by Satake Chemical Equipment Mfg., Ltd.). While stirring the resultant dispersion, a 2% by weight aqueous solution (obtained by adjusting pH to 4 with acetic acid to dissolve) containing 2.24 parts by weight of γ-methacryloxypropyltrimethoxysilane (A-174, trade name, minimum area coverage: 316 $m^2/g$, product of Nippon Unicar Co., Ltd.) was then added to the dispersion. A proportion of an area covered with the coupling agent by the surface treatment of the surface area of the resultant alumina hydrate was 3.0%. The proportion of the area covered was determined by calculation from the amount (100 parts by weight×235.6 ($m^2/g$)/316 ($m^2/g$)=74.56 parts by weight) of γ-methacryloxypropyltrimethoxysilane to be added for covering 100 parts by weight of the alumina hydrate by 100%.

An aqueous solution (solids concentration: 10%) obtained by dissolving polyvinyl alcohol (Gohsenol GH-23, trade name, product of The Nippon Synthetic Chemical Industry Co., Ltd.) in deionized water was weighed out so as to give a weight ratio of Alumina Hydrate B to the polyvinyl alcohol in terms of solids (P/B ratio) of 10:1, and added to the above-prepared dispersion. A water-soluble melamine resin (SUMIREZ RESIN 613 Special, trade name, product of Sumitomo Chemical Co., Ltd.) as a hardener was further added to the dispersion so as to give a weight ratio of the polyvinyl alcohol to the hardener in terms of solids of 10:2.5. The resultant mixture was stirred for 3 hours at a rotating speed of 1,450 rpm. thereby obtaining a mixed dispersion (the total solids concentration of the alumina hydrate, polyvinyl alcohol and water-soluble melamine resin: 18% by weight) finally containing the alumina hydrate and (the polyvinyl alcohol and the water-soluble melamine resin) In a weight ratio of 8:1.

The mixed dispersion was applied at a coating rate of 10 m/min by kiss coating onto the same PET film as that used in EXAMPLE 1 while subjecting the surface of the film to a corona discharge treatment, and dried at 145° C. to form Ink-receiving Layer (C) having a dry coating thickness of 40 μm. The BET specific surface area and total pore volume of Ink-receiving Layer (C) were 180 $m^2/g$ and 0.58 $cm^3/g$, respectively, as determined by the same methods as in Ink-receiving Layer (A).

Preparation of Release Sheets 1 to 7 Provided with an Adhesive Layer

The recessed and projected structures of the release sheets, and the recessed and projected structures of the adhesive layers of Release Sheets 1 to 7 provided with an adhesive layer are shown collectively in Table 1. The release sheets provided with an adhesive layer were prepared in the following manner.

(Release Sheet 1 Provided with an Adhesive Layer)

Latticed projected portions were formed on a polyethylene terephthalate (PET) film having a thickness of 38 μm by pressing an embossing die against the film to obtain a release sheet having a structure that recessed portions and projected portions having the respective sizes shown in Table 1 are regularly repeated. After a silicone resin was applied to a surface of the release sheet, on which an adhesive layer was to be provided, an adhesive (BPS-5160, trade name, product of Toyo Ink Mfg. Co., Ltd.) was applied to a thickness of 30 μm onto the silicone resin layer and dried to form the adhesive layer, thereby obtaining Release Sheet 1 provided with the adhesive layer.

(Release Sheet 2 Provided with an Adhesive Layer)

Polyethylene was laminated to a thickness of 30 μm on woodfree paper having a basis weight of 110 $g/m^2$, and latticed projected portions of a size shown in Table 1 were formed on the paper by pressing an embossing die against the paper to obtain a release sheet. After a silicone resin was applied to a surface of the release sheet, on which an adhesive layer was to be provided, an adhesive (BPS-5160, trade name, product of Toyo Ink Mfg. Co., Ltd.) was applied to a thickness of 30 μm onto the silicone resin layer and dried to form the adhesive layer, thereby obtaining Release Sheet 2 provided with the adhesive layer.

(Release Sheet 3 Provided with an Adhesive Layer)

Release Sheet 3 provided with an adhesive layer was obtained in the same manner as in Release Sheet 1 provided with the adhesive layer except that the coating thickness of the adhesive was changed to 60 μm.

(Release Sheet 4 Provided with an Adhesive Layer)

Release Sheet 4 provided with an adhesive layer was obtained in the same manner as in Release Sheet 1 provided with the adhesive layer except that the PET film was used as it is without conducting no processing treatment for forming the recessed and projected structure.

(Release Sheets 5 and 6 Provided with an Adhesive Layer)

Release Sheets 5 and 6 provided with an adhesive layer were obtained in the same manner as in Release Sheet 1provided with the adhesive layer except that the recessed and projected structure was respectively changed as shown in Table 1.

(Release Sheet 7 Provided with an Adhesive Layer)

Release Sheet 7 provided with an adhesive layer was obtained in the same manner as in Release Sheet 6 provided with the adhesive layer except that a surface opposite to the surface, on which the adhesive layer was provided, of Release Sheet 6 provided with the adhesive layer was subjected to an antistatic treatment in accordance with the following process. Process for obtaining a release sheet provided with an antistatic treatment layer A cationic acrylic resin (Julymer, trade name, product of Nihon Junyaku Co., Ltd.) diluted with a mixed solvent containing water and isopropyl alcohol at a weight ratio of 7:3 was applied to a PET film having a thickness of 38 μm by a wire bar so as to give a dry coating thickness of about 1 μm, and then dried at 110° C. for 3 minutes. After the drying, latticed projected portions were formed by embossing in the same manner as in Release Sheet 1 provided with the adhesive layer to obtain a release Sheet provided with the antistatic treatment layer.

Production of Recording Medium

Each of the release sheets provided with the adhesive layer obtained in the above-described manner was laminated on the back surface of the base material having the ink-receiving layer previously obtained to obtain recording media of EXAMPLES 1 to 8 and COMPARATIVE EXAMPLE 1. The combinations of Release Sheets 1 to 7 provided with the adhesive layer with Ink-receiving Layers (A) and (C) are as shown in Table 2.

Evaluation Method

The recording media produced in the above-described manner were evaluated as to the following items. The results thereof are shown in Table 3.

1) Conveyability

A bubble-jet printer BJF850 (trade name, manufactured by Canon Inc.) was used, and ten sheets of each recording medium sample were stacked in the printer to conduct a conveyance test, thereby evaluating each recording medium in accordance with the following standard.

A: Conveyable without problems;

B: Defective conveyance such as conveyance failure or conveyance together with another recording medium occurred once;

C: Defective conveyance such as conveyance failure or conveyance together with another recording medium frequently occurred.

2) Blemish Upon Conveyance

The recording medium samples after the conveyance test were visually observed 30 cm apart to evaluate them in accordance with the following standard.

A: No blemish was observed;

B: Intermediate between ranks A and C;

C: Blemish was clearly observed.

3) Squeezing-out of Adhesive Layer

A recording medium sample produced was cut by a guillotine cutter (manufactured by Lion Corporation) to touch the cut section with a finger, thereby evaluating it in accordance with the following standard.

A: No stickiness was felt;

B: Intermediate between ranks A and C;

C: Stickiness was clearly felt

4) Entrapment of Air

After a recording medium sample was cut out into a 20-cm square, and the release sheet was peeled off from the cut medium, the cut medium was stuck on a flat glass plate. A state of the recessed and projected portions of the adhesive layer adhered was observed from the opposite side of the glass plate to evaluate it in accordance with the following standard.

A: No entrapment of air was observed;

B: Air was entrapped, but easily removed;

C: Air was entrapped and hard to be removed.

5) Adhesiveness

A recording medium sample was cut out into a 3-cm square, and the cut medium was stuck on a curved surface of 5R. After the stuck medium was left to stand for 12 hours, it was observed to evaluate it in accordance with the following standard.

A: Not separated from the curved surface:

B: Being about to be separated from the curved surface;

C: Separated from the curved surface.

TABLE 1

| Release sheet with adhesive layer | Forms of projected portions of adhesive layer | | | Form of projected portions of release sheet | |
|---|---|---|---|---|---|
| | Width | Interval | Height | Width | Interval |
| (1) | 0.5 | 0.4 | 0.02 | 0.4 | 0.5 |
| (2) | 0.5 | 0.4 | 0.02 | 0.4 | 0.5 |
| (3) | 0.5 | 0.4 | 0.02 | 0.4 | 0.5 |
| (4) | None | None | None | None | None |
| (5) | 0.03 | 0.05 | 0.02 | 0.05 | 0.03 |
| (6) | 2 | 2 | 0.02 | 2 | 2 |
| (7) | 2 | 2 | 0.02 | 2 | 2 |

(unit:mm)

TABLE 2

| | Ink-receiving layer | Release sheet with adhesive layer |
|---|---|---|
| EXAMPLE 1 | A | (1) |
| EXAMPLE 2 | B | (1) |
| EXAMPLE 3 | C | (1) |
| EXAMPLE 4 | A | (2) |
| EXAMPLE 5 | A | (3) |
| EXAMPLE 6 | A | (5) |
| EXAMPLE 7 | A | (6) |
| EXAMPLE 8 | A | (7) |
| COMPARATIVE EXAMPLE 1 | A | (4) |

TABLE 3

| | Conveyability | Blemish upon conveyance | Squeezing-out of adhesive | Air entrapment | Adhesive-ness | Blemish after sticking | Cuttability |
|---|---|---|---|---|---|---|---|
| EX. 1 | A | A | A | A | A | A | A |
| EX. 2 | A | A | A | A | A | A | A |
| EX. 3 | A | A | A | A | A | A | A |
| EX. 4 | A | A | A | A | A | A | B |
| EX. 5 | A | A | B | A | A | A | A |
| EX. 6 | A | A | A | B | B | B | A |
| EX. 7 | B | B | A | B | A | A | A |
| EX. 8 | A | B | A | B | A | A | A |
| COMP. EX. 1 | C | C | A | C | A | C | A |

6) Blemish After Sticking

After the air entrapment test was conducted, the surface of the ink-receiving layer was visually observed 30 cm apart to evaluate it in accordance with the following standard.

A: No blemish was observed;

B: Intermediate between ranks A and C:

C: Blemish was clearly observed.

7) Cuttability

Upon cutting operation of a recording medium sample, whether burr occurred at ends of the recording medium or not was observed to evaluate it in accordance with the following standard.

A: No burr was observed:

B: Burr was somewhat observed;

C: Burr was markedly observed.

According to the recording media of the present invention, frictional force when plural recording media are stacked in a printer is lowered compared with the case where the smooth surfaces come into contact with each other, since the ink-receiving layer having a smooth surface comes into contact with the release sheet having the recessed and projected surface structure, so that good conveyability into a printer from a stacked state can be achieved. In addition, the recessed and projected structure on the release sheet side is regular, whereby the frictional force is not partially lowered with a partial bias of the recessed and projected structure, but almost evenly lowered over the whole surface of the release sheet, so that better conveyability can be achieved. Further, the top of each of the projected portions on the release sheet of one recording medium is substantially flat, whereby the ink-receiving layer of another recording medium is prevented from being easily blemished. As a result, the deterioration of image quality can be prevented.

In addition, since the release sheet has a regular recessed and projected structure, the rigidity of the recording medium is lowered as a secondary effect, so that its conveyability within a printer is improved. Further, strain caused upon the formation of the adhesive layer is easy to escape (internal stress is easy to relax), so that curling of the recording medium can be controlled with ease.

When the recording medium is stuck as an adhesive sheet on the surface of an adherend, only the projected portions of the recessed and projected structure formed in the adhesive Layer come into close contact with the surface of the adherend, and moreover a space communicating with the outside is produced between the adhesive layer and the surface of the adherend, so that air escapes out through the space. Therefore, even when air enters between the adherend and the adhesive layer, the air can be easily remove to the outside. Therefore, even when the ink-receiving layer containing the alumina hydrate, which tends to be blemished when air removal is forcedly conducted, is used, no air is entrapped when the recording medium is stuck as an adhesive sheet on an adherend, so that blemishing of the ink-receiving layer caused by the air removal is prevented from occurring. In addition, a problem of the attachment of fingerprints caused by conducting the air-removal operation in excess can also be avoided.

When the recording medium is stuck as an adhesive sheet through the adhesive layer on an adherend, portions coming into contact with the adherend are only the projected portions of the adhesive layer because the surface of the adhesive layer has the regular recessed and projected structure, so that the contact area with the adherend is lessened. Therefore, the adhesive sheet can be easily peeled off and stuck again even when it has been stuck on a wrong position.

When the base material used in the recording medium according to the present invention is transparent, the see-through of the recording medium can be enhanced, since an even adhesive layer is formed by the deformation of the projected portions of the adhesive layer. Therefore, the use of the recording medium according to the present invention permits providing a transparent adhesive seal or label.

What is claimed is:

1. A recording medium for use in an ink-jet recording system in which a plurality of recording media are continuously conveyed, said recording medium comprising a base material, an ink-receiving layer containing an alumina hydrate provided on one side of the base material, an adhesive layer provided on the side opposite to the ink-receiving layer of the base material, and a release sheet covering the adhesive layer, wherein the surface of the adhesive layer on the side of the release sheet has such structure that recessed portions and projected portions are regularly repeated, and a recessed and projected surface corresponding to the recessed portions and the projected portions of said surface of the adhesive layer is formed by the release sheet covering the adhesive layer;

wherein the width of each of the projected portions in the recessed and projected portions formed on the surface of the release sheet is within a range of from 0.1 to 1 mm; and wherein the interval between the projected portions opposite to each other in the recessed and projected portions formed on the surface of the release sheet is within a range of from 0.05 to 1 mm.

2. The recording medium according to claim 1, wherein the thickness of the adhesive layer is within a range of from 5 to 55 $\mu$m.

3. The recording medium according to claim 1 or 2, wherein the thickness of the release sheet is within a range of from 5 to 100 $\mu$m.

4. The recording medium according to claim 1, wherein the portion of the release sheet, which covers the adhesive layer, is formed of a polyester film.

5. The recording medium according to claim 1, wherein the recessed and projected portions formed on the surface of the release sheet are formed by embossing.

6. The recording medium according to claim 1, wherein the recessed and projected portions formed on the surface of the release sheet are composed of latticed projected portions and recessed portions provided between the projected portions.

7. The recording medium according to claim 1, wherein the width of each of the projected portions in the recessed and projected portions formed on the surface of the adhesive layer is within a range of from 0.05 to 1 mm.

8. The recording medium according to claim 1, wherein the interval between the projected portions opposite to each other in the recessed and projected portions formed on the surface of the adhesive layer is within a range of from 0.1 to 1 mm.

9. The recording medium according to claim 1, wherein the height of each of the projected portions in the recessed and projected portions formed on the surface of the adhesive layer is within a range of from 0.005 to 0.1 mm.

10. The recording medium according to claim 1, wherein the surface opposite to the adhesive layer of the release sheet is subjected to an antistatic treatment.

* * * * *

UNITED STATES PATENT AND TRADEMARK OFFICE

CERTIFICATE OF CORRECTION

PATENT NO. : 6,652,929 B2
DATED : November 25, 2003
INVENTOR(S) : Kenichi Moriya et al.

It is certified that error appears in the above-identified patent and that said Letters Patent is hereby corrected as shown below:

Column 1,
Line 49, “an black” should read -- a black --.

Column 4,
Line 49, “hydrates” should read -- hydrate --.
Line 50, “boehymite” should read -- boehmite --.

Column 5,
Line 17, “such as.” should read -- such as --.

Column 6,
Line 6, “sino curve” should read -- sine curve --.

Column 7,
Line 4, “sheet, It” should read -- sheet, it --.
Line 10, “about the future” should read -- in the future --.

Column 8,
Line 58, “is can be” should read -- can be --.

Column 13,
Line 2, “EXAMPLES 1” should read -- EXAMPLE 1 --.
Line 8, “In accordance” should read -- in accordance --.
Line 46, “pore is” should read -- pore --.

Column 15,
Line 28, “In a” should read -- in a --.

Column 16,
Line 28, “process. Process” should read -- process. ¶Process --.

UNITED STATES PATENT AND TRADEMARK OFFICE

CERTIFICATE OF CORRECTION

PATENT NO. : 6,652,929 B2
DATED : November 25, 2003
INVENTOR(S) : Kenichi Moriya et al.

It is certified that error appears in the above-identified patent and that said Letters Patent is hereby corrected as shown below:

Column 18,
Line 3, “Form of” should read -- Forms of --.

Column 19,
Line 11, “Layer come” should read -- layer come --.
Line 16, “remove” should read -- removed --.

Signed and Sealed this

Twenty-second Day of June, 2004

JON W. DUDAS
*Acting Director of the United States Patent and Trademark Office*